US005555579A

United States Patent [19]

Wu

[11] Patent Number: 5,555,579

[45] Date of Patent: Sep. 17, 1996

[54] MATTRESS ASSEMBLY WITH SEMICONDUCTOR THERMO-CONTROL

[76] Inventor: Wen-Pin Wu, 4F. No. 6-3, Lane 208, Szu Wei Road, Taipei, Taiwan

[21] Appl. No.: 250,870

[22] Filed: Mar. 3, 1994

[51] Int. Cl.[6] ..... A47C 21/04

[52] U.S. Cl. ..... 5/421; 5/284; 165/46

[58] Field of Search ..... 5/421, 422, 284; 63/3.3; 165/46, 61; 607/104

[56] References Cited

U.S. PATENT DOCUMENTS

| | | | |
|---|---|---|---|
| 2,093,834 | 9/1937 | Gaugler | 5/284 |
| 2,250,325 | 7/1941 | Barnes | 165/46 |
| 2,504,308 | 4/1950 | Donkle | 165/46 |
| 4,777,802 | 10/1988 | Feher | 62/3.3 |
| 4,884,304 | 12/1989 | Elkins | 5/421 |
| 5,038,852 | 8/1991 | Johnson | 236/46 R |

*Primary Examiner*—Flemming Saether
*Attorney, Agent, or Firm*—Donald C. Casey

[57] ABSTRACT

A mattress assembly includes a mattress having a network of grooves at the top covered within a soft covering layer, a control box, a water piping arranged within the network of grooves and connected to hot and cold water reservoirs inside the control box, the control box having a semiconductor chip controlled by a control circuit to heat the hot water reservoir and to cool the cold water reservoir, and hot and cold water pumps respectively controlled by the control circuit to send water from the hot or cold water reservoir to the water piping in regulating the temperature of the mattress.

3 Claims, 3 Drawing Sheets

MATTRESS ASSEMBLY WITH SEMICONDUCTOR THERMO-CONTROL

BACKGROUND OF THE INVENTION

The present invention relates to mattresses and relates more particularly to a mattress assembly having a semiconductor thermo-control for regulating the temperature of the mattress by means of the operation of a semiconductor chip and two separate water pumps through the control of an electronic control circuit.

Water beds with temperature controls are known and widely accepted for the advantage of temperature adjustability. However, these types of water beds are not movable when filled with water, and they consume much energy to change the temperature. Another drawback of these types of water beds is that the water beds may be pierced easily causing a water leakage.

SUMMARY OF THE INVENTION

The present invention has been accomplished under the aforesaid circumstances. It is therefore an object of the present invention to provide a mattress assembly which can be conveniently controlled to regulate the temperature. It is another object of the present invention to provide a mattress assembly which is lightweight and can be moved easily when set. It is still another object of the present invention to provide a mattress assembly which eliminates the leakage of water. It is still another object of the present invention to provide a mattress assembly in which the electronic control unit is separated from the mattress so that it is safe in use.

According to the preferred embodiment of the present invention, a semiconductor chip which exhibits a peltier effect is provided and operated to cause an effect in reducing the temperature at one side for cooling a cold water reservoir and increasing the temperature at an opposite side for heating a hot water reservoir; a water circulation system is provided having water pumps controlled by an electronic control circuit to pump water from the hot or cold water reservoir through a water piping being arranged with the mattress.

DETAILED DESCRIPTION OF THE PREFERRED EMBODIMENT

Figure 1:
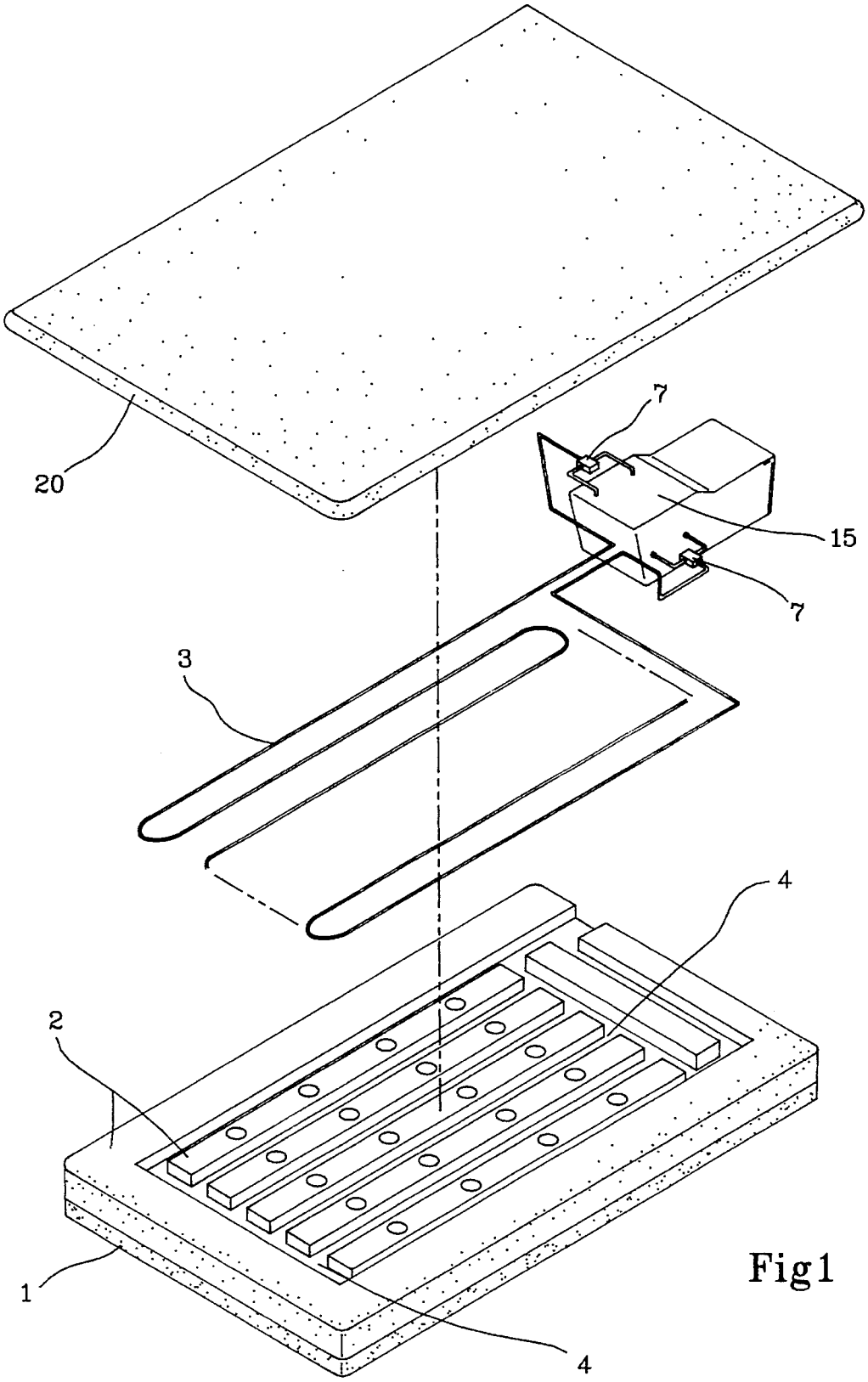
FIG. 1 is an exploded view of a mattress assembly according to the preferred embodiment of the present invention.
Figure 2:
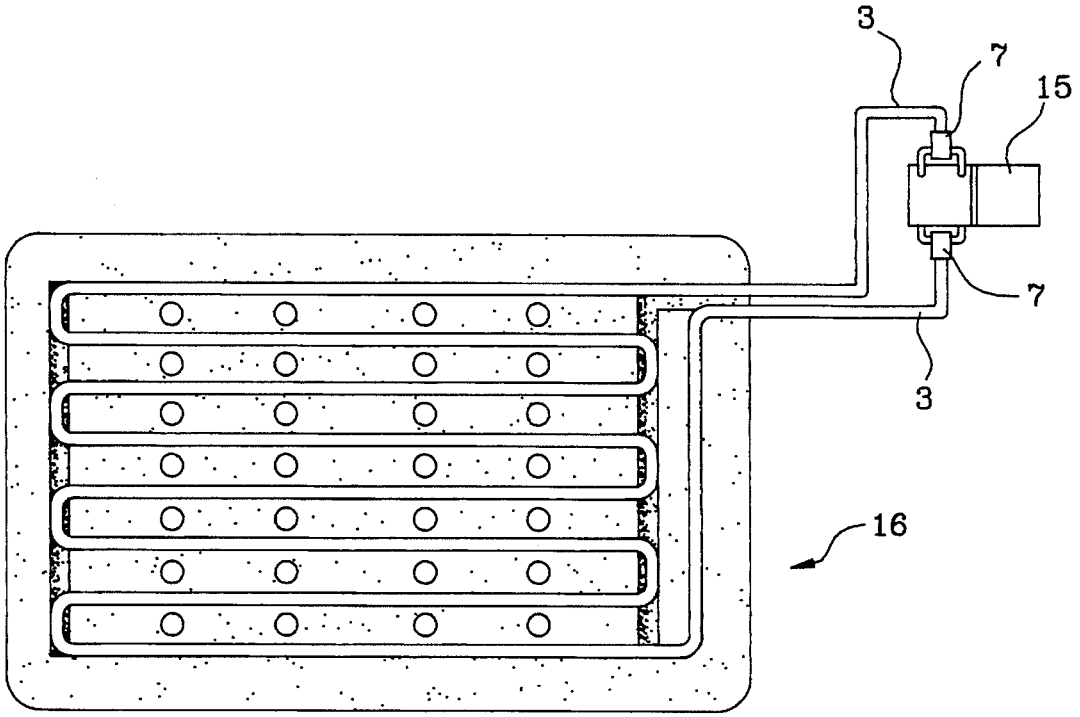
FIG. 2 is a sectional assembly view of the mattress assembly shown in FIG. 1.
Figure 3:
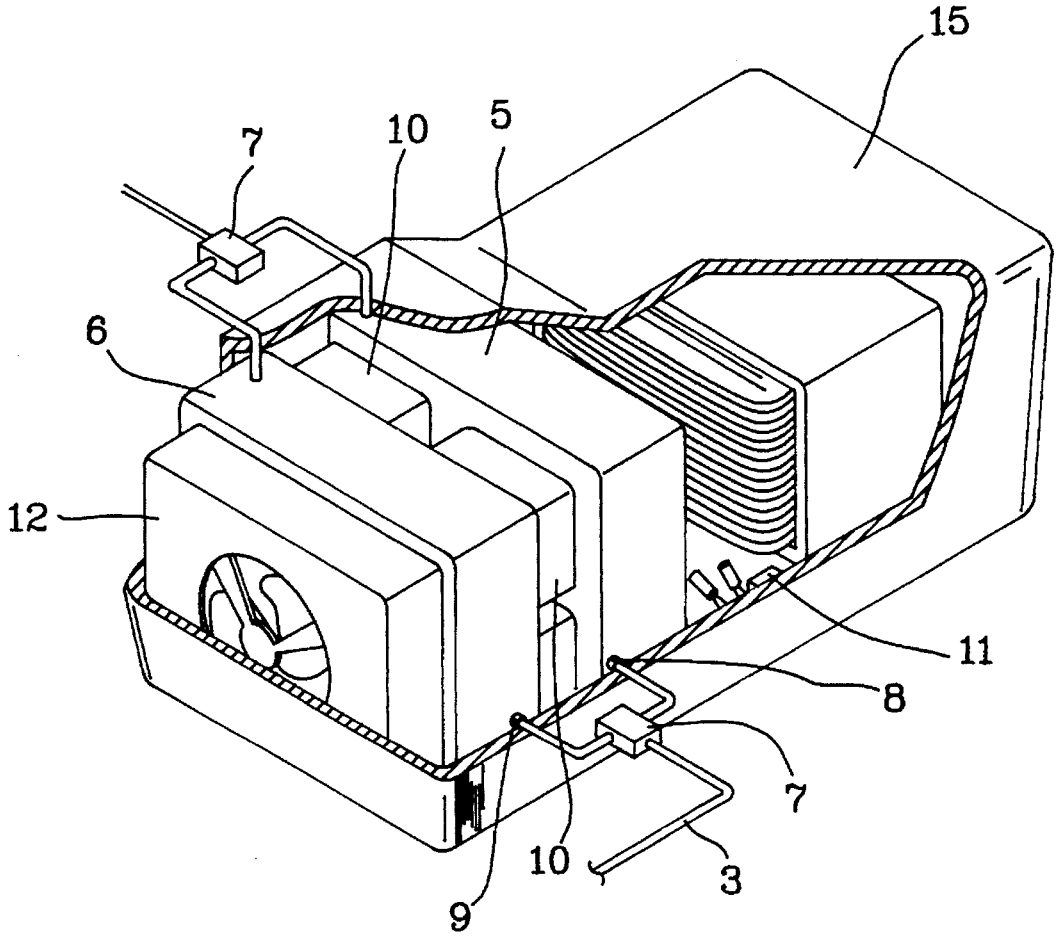
FIG. 3 is a cutaway of the control box of the mattress assembly shown in FIG. 1.

Referring to FIGS. 1, 2, and 3, a mattress assembly in accordance with the preferred embodiment of the present invention is generally comprised of a mattress 16, which includes a bottom mattress unit 1 and a top mattress unit 2, a water piping 3, a cold water reservoir 5, a hot water reservoir 6, a semiconductor chip 10, a cold water pump 8, a hot water pump 9, two valves 7, and an electronic control circuit 11. When the semiconductor chip is electrically connected, it causes an effect in reducing the temperature at one side for cooling water in the cold water reservoir 5 and increasing the temperature at an opposite side for heating water in the hot water reservoir 6. By means of the control of the electronic control circuit 11, the water pumps 8;9 and the valves 7 are operated to send hot or cold water to the inside of the mattress 16 through the water piping 3.

As indicated, the mattress is comprised of a bottom mattress unit 1 and a top mattress unit 2 sealed to the bottom mattress unit 1 at the top. The bottom mattress unit 1 is made of high density foamed plastics in an integral piece. The top mattress unit 2 has, when molded, a network of grooves 4 on the top wall thereof, which receive the water piping 3. After the water piping 3 has been arranged within the network of grooves 4, a soft covering layer 20 is fastened to the top mattress unit 2 and covered over the water piping 3. When the mattress 16 is assembled, it is linked to a control box 15 by the water piping 3.

The aforesaid cold water reservoir 5, hot water reservoir 6, semiconductor chip 10, cold water pump 8, hot water pump 9, and electronic control circuit 11 are installed inside the control box 15. The water piping 3 has two opposite ends connected to the cold and hot water reservoirs 5;6 through the valves 7 at both sides. When operated, the electronic control circuit 11 connects power supply to the semiconductor chip 10 causing it to increase the temperature at one side and reduces the temperature at an opposite side. The cold water reservoir 5 and the hot water reservoir 6 are respectively and closely attached to the semiconductor chip 10 at two opposite sides. When the semiconductor chip 10 works, the cold water reservoir 5 is cooled and the hot water reservoir 6 is heated. By means of the control of the electronic control circuit 11, the cold and hot water pumps 8;9 are operated to send hot (cold) water from the hot water reservoir 6 (cold water reservoir 5) through the water piping 3, and therefore the temperature of the mattress 16 (more particularly the soft covering layer 20) is changed. The arrangement of the valves 7 allows water to be circulated through the cold and hot water reservoirs 5;6 in one direction.

The semiconductor chip 10 is made of antimony covered inside a ceramic covering, having two opposite conductors respectively connected to the two opposite terminals of the electronic control circuit 11. When operated, the semiconductor chip 10 exhibiting the peltier effect can increase the temperature at one side up to 100° C. and reduce the temperature at an opposite side down to 0° C.

The hot water reservoir 12 is mounted with a heat dissipating device to dissipate heat. The heat dissipating device can be a radiating flange or cooling fan.

While only one embodiment of the present invention has been shown and described, it will be understood that various modifications and changes could be made without departing from the spirit and scope of the invention. For example, the present invention can be used in all kinds of sofas and seats; magnetic massaging elements may be installed in the top mattress unit at the top for stimulating the circulation of blood.

What is claimed is:

1. A mattress assembly comprising:

a mattress having a network of internal grooves and a soft covering layer therefor;

a water piping means arranged within said network of grooves and having two opposite ends extended out of said mattress; and a control box connected to the two opposite ends of said water piping, said control box comprising an electronic control circuit, a semiconductor chip having opposed sides coupled to said circuit, a cold water reservoir disposed adjacent one side of said semiconductor chip, a hot water reservoir disposed adjacent the opposite side of said semiconductor chip, heat dissipating means mounted on said hot water reservoir on a side opposite said semiconductor chip, said semiconductor chip being coupled to said electronic control circuit so that the flow of electricity therethrough will cause the temperature at one side adjacent said cold water reservoir to decrease and the temperature at an opposite side adjacent said hot water reservoir increase, said cold and hot water reservoirs having respective inlet and output ports connected each to one end of said water piping means valve means at said ports for controlling the flow therethrough and a hot water pump coupled to said electronic control circuit to pump water from the output port of said hot water reservoir to the input port thereof through said water piping, and a cold water pump coupled to said electronic control circuit to pump water from the output port of said cold water reservoir to the input port thereof through said water piping.

2. The mattress assembly of claim 1 wherein said heat dissipating means is a cooling fan.

3. The mattress assembly of claim 1 wherein said mattress comprises a bottom layer of high density formed plastic and, a top layer sealed to said bottom layer, said top layer defining said internal grooves and being covered by said soft covering layer.

* * * * *